United States Patent [19]

Carlin et al.

[11] Patent Number: 4,530,742

[45] Date of Patent: Jul. 23, 1985

[54] ELECTRODE AND METHOD OF PREPARING SAME

[75] Inventors: William W. Carlin, Akron; Debra S. Marzec, Uniontown, both of Ohio

[73] Assignee: PPG Industries, Inc., Pittsburgh, Pa.

[21] Appl. No.: 543,577

[22] Filed: Oct. 19, 1983

Related U.S. Application Data

[63] Continuation-in-part of Ser. No. 461,096, Jan. 26, 1983, abandoned.

[51] Int. Cl.[3] ..... C25B 1/26

[52] U.S. Cl. ..... 204/95; 204/268; 204/270; 204/290 R; 204/290 F; 427/125; 427/226; 427/229; 427/380

[58] Field of Search ..... 204/290 F, 290 R, 268, 204/270, 95, 242; 427/125, 226, 229, 380

[56] References Cited

U.S. PATENT DOCUMENTS

| | | | |
|---|---|---|---|
| 2,799,643 | 7/1957 | Raetzsch et al. | 204/270 |
| 3,701,724 | 10/1972 | Entwisle et al. | 204/290 F |
| 3,776,834 | 12/1973 | O'Leary | 204/290 F |
| 3,902,985 | 9/1975 | Raetzsch et al. | 204/268 |
| 4,070,504 | 1/1978 | Bianchi et al. | 204/290 F |
| 4,075,070 | 2/1978 | DuBois et al. | 204/129 |
| 4,100,049 | 7/1978 | Brannan | 204/242 |
| 4,157,943 | 6/1979 | Scarpellino et al. | 204/290 F |
| 4,214,971 | 7/1980 | Heikel et al. | 204/290 F |
| 4,297,195 | 10/1981 | Sato et al. | 204/290 F |
| 4,377,454 | 3/1983 | Bommaraju | 204/95 |
| 4,426,262 | 1/1984 | Langley et al. | 204/290 F |
| 4,431,686 | 2/1984 | Bewer et al. | 204/290 F |

OTHER PUBLICATIONS

"The Effectiveness of Metallic-Undercoats in Minimizing Plating Embrittle. of Ultra High Str. Steel" by Beck et al., 47th Annual Tech. Proceedings, A.E.S., 1960, pp. 152-159.

*Primary Examiner*—R. L. Andrews

*Attorney, Agent, or Firm*—Bruce H. Cottrell; Irwin M. Stein

[57] ABSTRACT

Disclosed are electrodes, e.g., cathodes useful for the preparation of alkali metal halates. The electrodes comprise a substrate selected from the group consisting of titanium, steel, copper, nickel and silver and, in one embodiment, a coating of a Group VIII metal oxide selected from the group consisting of ruthenium, cobalt, rhodium, iridium, nickel, palladium and platinum. In a further embodiment, the coating also contains at least one Group IV metal oxide, e.g., titanium and tin.

34 Claims, No Drawings

ELECTRODE AND METHOD OF PREPARING SAME

CROSS REFERENCE TO RELATED APPLICATIONS

This application is a continuation-in-part application of our application Ser. No. 461,096, filed Jan. 26, 1983, now abandoned, for Cathode Electrocatalyst and Method of Preparing Same.

DESCRIPTION OF THE INVENTION

Alkali metal chlorates are prepared by the electrolysis of aqueous alkali metal chloride solutions in an electrolytic cell wherein the anode and cathode face each other within the same electrolyte chamber. That is, the anode and cathode are not separated from each other by a diaphragm or permionic membrane as is the usual case in a chlorine cell. One form of an electrolytic cell utilized for the synthesis of alkali metal chlorates is a cell having base-to-base bipolar electrodes where each single back-to-back bipolar electrode is arrayed in side-by-side configuration between a pair of bipolar electrodes parallel thereto and spaced therefrom. A structure of this type having individually prepared perforated anodes and individually prepared perforated cathodes on an individually fabricated bipolar element is shown in U.S. Pat. No. 3,902,985 to Carl W. Raetzsch et al.

It has been postulated that significant economies would result if a single metal blade could function as an anode for a portion of its length and a cathode for the remaining portion of its length. This is an extension of the bipolar configuration shown in U.S. Pat. No. 2,799,643 to Carl W. Raetzsch where a single plate of graphite functioned as an anode for a portion of its length and a cathode for the balance of its length.

One metal suitable for providing both the anode and the cathode is titanium. Titanium, however, is subject to hydride formation. According to the invention herein contemplated a coating or layer is provided on a suitable conductive substrate, e.g., titanium, which coating or layer is both (1) a barrier to the migration of nascent hydrogen, and (2) an electrocatalyst for the reactions that take place at the cathode, and preferably at both the cathode and the anode. While the herein contemplated coating barrier is effective to substantially prevent hydride formation, in a preferred exemplification the titanium is an alloy which is itself resistant to hydride formation, e.g., an alloy of titanium and yttrium as described in U.S. Pat. No. 4,075,070 of Donald W. DuBois et al. The use of the titanium-yttrium alloy allows a single piece of titanium to function as an anode along one portion of its length and as a cathode upon the balance of its length. It is believed that the titanium-yttrium alloy provides a particularly desirable cathode substrate because of the resistance of the titanium yttrium alloy to hydride formation.

According to one exemplification of the invention contemplated herein, it has been found that the presence of the electrocatalytic, hydrogen barrier surface on a titanium-yttrium blade, especially the portion thereof intended to function as a cathode, provides a particularly desirable cathodic surface.

As the conductive substrate for the electrodes described herein, there can be used titanium or titanium alloys, said alloys, for example, containing minor amounts of one or more metals from Group VIII or Group III of the Periodic Chart of the Elements. Exemplifications of said titanium alloys include substrates of titanium-palladium, titanium-aluminum-manganese, and titanium-yttrium. Alloys of titanium useful as substrates for electrodes in electrolytic cells are well known to those skilled in the art and any of such suitable alloys can be used in the present invention.

In addition to titanium and its alloys, the conductive substrate can be nickel, copper or silver. Iron, steel, stainless steel or a conductive ferrous metal can also be used as the substrate if first protected from corrosion by a protective coating of silver, copper or a Group VIII metal coating in the manner known in the art. For example, mild steel and copper can be coated with chemically deposited nickel-phosphorous, nickel, or nickel-iron.

In accordance with the present invention, the conductive substrate is coated with at least one oxide of a Group VIII metal selected from the group consisting of ruthenium, cobalt, rhodium, iridium, nickel, palladium and platinum. Particularly useful multiple metal oxide coatings contemplated are those of ruthenium and iridium, platinum and iridium and ruthenium with one or more of the other Group VIII metal oxides. Such electrodes are contemplated as useful as cathodes in monopolar or bipolar cells for the preparation of alkali metal halates, e.g., chlorates, alkali metal perhalates, e.g., perchlorates, and alkali metal hypohalites, e.g., sodium hypochlorite.

In addition to the above coatings, the conductive substrate can be coated with one or more oxides of the aforedescribed Group VIII metals containing one or more oxides of a Group IV metal. Examples of Group IV metals are titanium, zirconium, hafnium, silicon, germanium, tin and lead. The Group VIII metal oxide can be present in a major amount and the Group IV metal oxide in minor amounts. Particularly useful multiple metal oxide coatings of this type contemplated are those of ruthenium-tin, ruthenium-tin-palladium, ruthenium-iridium-titanium, and ruthenium-iridium-titanium and tin. Such electrodes are contemplated as useful as both cathodes and anodes in monopolar or bipolar electrolytic cells for the preparation of alkali metal halates, perhalates and hypochlorites. By alkali metal is meant, the metals of Group IA of the Periodic chart of the Elements, e.g., sodium, potassium, and lithium especially sodium and potassium.

The coatings can be applied in multiple layers, e.g., two to eight layers, and the various layers can vary in composition, as described in connection with a preferred exemplification hereinafter. The coatings can be applied by any suitable technique known in the art such as electroless deposition, electrolytic deposition, spraying, immersion in a bath, painting, etc.

According to one particular exemplication of the invention herein contemplated, there is provided an electrode, for example, a bipolar electrode, or a cathode, with a ruthenium oxide-tin oxide layer and ruthenium oxide-palladium oxide-tin oxide outer coating thereon, which layer and coating are substantially free of deposited titanium. The first layer is on the conductive substrate and contains a major portion of ruthenium and a minor portion of tin. The second layer, atop the first layer, contains a major portion of ruthenium, and minor portions of tin and palladium. The substrate can be titanium, a titanium alloy, or, in a preferred exemplification, a titanium alloy substantially resistant to hydride formation.

According to an alternative exemplification of the invention herein contemplated, there is provided a bipolar electrolyzer, having substantially the structure shown in U.S. Pat. No. 2,799,643. The electrolyzer has a plurality of bipolar electrodes which are parallel to and spaced from each other, each of the bipolar electrodes comprising a titanium plate having an anodic portion and a coated cathodic portion whereby the cathodic portion of one bipolar electrode faces the anodic portion of a prior bipolar electrode and the anodic portion of the bipolar electrode faces the cathodic portion of a subsequent bipolar electrode. In one embodiment the titanium plate contains a hydride formation inhibiting amount of yttrium, the cathodic coating is substantially free of deposited titanium, and contains ruthenium, palladium, and tin. The first layer of the cathodic coating is normally deposited directly on the electrode plate and contains a major portion of ruthenium oxide and a minor portion of tin oxide. The second or external layer, which is atop the first layer, contains a major portion of ruthenium oxide and minor portions of tin oxide and palladium oxide.

The electrodes herein contemplated may be utilized in a bipolar electrolyzer having a plurality of anodes which extend into the electrolyzer from one end and a plurality of cathodes which extend into the electrolyzer from an opposite end of the electrolyzer. A plurality of bipolar electrode blades are in the electrolytic cell. Each of the bipolar electrode blades has a cathodic portion and an anodic portion, the anodes, cathodes, and bipolar electrode blades being mutually parallel. The first group of bipolar electrode blades are arrayed between and parallel to the anodes and have the cathodic portions of the bipolar electrode blades posed to the anodes which come through the cell boundary. The anodic portions of the bipolar electrodes are remote from the individual anodes. The last group of bipolar electrode blades are arrayed between and parallel to the independent cathodes which extend inwardly from the cell wall and have the anodic portions thereof opposed to the individual cathodes and the cathodic portions of the bipolar elements removed from the cathodes. Each of the bipolar electrode blades is titanium, the cathodic portions thereof having the herein contemplated hydrogen barrier coating. In a preferred exemplification the bipolar elements further comprise a titanium substrate containing a hydride formation inhibiting amount of yttrium. Each bipolar electrode blade has a coating thereon that is substantially free of deposited titanium and contains a first layer deposited on the substrate, containing a major portion of ruthenium oxide and a minor portion of tin oxide, and a second layer, atop the first layer, comprising a major portion of ruthenium oxide and minor portions of tin oxide and palladium oxide.

The electrodes and electrolytic cells herein contemplated are useful in electrolyzing alkali metal chloride brines, for example, sodium chloride brines or potassium chloride brines, to yield alkali metal chlorates, for example, sodium chlorates or potassium chlorates. The electrolysis is carried out by a method of passing electrical current from an anode to a cathode in a common electrolyte, evolving anodic and cathodic products and forming chlorate ion. According to the invention herein contemplated the electrodes comprise a titanium substrate which may contain a hydride formation inhibiting amount of yttrium, the electrodes having a hydrogen barrier coating. The coating is in two layers, the first layer deposited directly on the substrate comprising a major portion of ruthenium oxide and a minor portion of tin oxide, and the second layer, atop the first layer, comprising a major portion of ruthenium oxide and minor portions of tin oxide and palladium oxide. The electrodes are also useful in the preparation by electrolysis of alkali metal perhalates, e.g., sodium perchlorate, and alkali metal hypohalites, e.g., sodium hypochlorite.

The electrodes herein contemplated may be conveniently prepared by depositing a composition consisting essentially of a solvent, a thermally decomposable ruthenium compound, and a thermally decomposable tin compound onto either the metallic conductive substrate, e.g., the titanium substrate or the titanium-yttrium alloy substrate, and thereafter decomposing the ruthenium compound and the tin compound in an oxidizing atmosphere to form a first layer. Thereafter, a second composition, which consists essentially of a solvent, a thermally decomposable ruthenium compound, a thermally decomposable tin compound, and a thermally decomposable palladium compound is deposited atop the first layer and decomposed in an oxidizing atmosphere to form the second layer. The resulting electrode is believed to have an outer layer of an oxide, oxy compound, or mixed oxide of ruthenium, palladium, and tin, with an inner layer of an oxide, oxy compound, or mixed oxide of ruthenium and tin.

The conductive substrate, e.g., a titanium substrate, herein contemplated may be in the form of a sheet, plate, perforated mesh, expanded metal mesh or foraminous sheet or plate. It is typically a perforated or foraminous sheet or plate, or a mesh, whereby to allow the flow of electrolyte between the elements thereof. However, the individual elements are substantially impermeable to the flow of gas or electrolyte. The metallic substrate is preferably titanium, more preferably, an alloy of titanium and yttrium, the yttrium being present in an amount sufficient to reduce or even substantially prevent the formation of titanium hydride. Typically the yttrium is present at an amount of from about 0.0002 weight percent to about 0.01 weight percent, basis total titanium and yttrium.

In a more preferred embodiment, the electrocatalytic layer on the conductive, e.g., titanium, substrate comprises two layers, i.e., an intermediate layer of ruthenium oxide and tin oxide, and an external layer of ruthenium oxide, palladium oxide and tin oxide. The ruthenium, palladium, and tin are believed to be present as a non-stoichiometric, oxygen deficient, semiconductor, substantially impermeable to the flow of protons or hydrogen atoms.

The ruthenium oxide-tin oxide first layer, typically has a coating density of from about 1 gram per square meter to about 10 grams per square meter. The surface contains a major portion of ruthenium and a minor portion of tin, i.e., from about 75 weight percent ruthenium to about 90 weight percent ruthenium, balance tin, elemental metal basis. While higher or lower amounts of ruthenium may be present, the presence of rutile titanium dioxide is not necessary in the ruthenium-tin oxide layer.

The external surface typically has a coating density of about 1 gram per square meter to about 10 grams per square meter and contains a major portion of ruthenium, and minor portions of palladium and tin. This outer coating typically contains from about 80 to about 85 weight percent ruthenium, balance palladium and tin, e.g., from about 7 to about 10 weight percent palladium, and from about 6 to about 10 weight percent tin, elemental metal basis. The external coating is also characterized by the substantial absence of deposited rutile formed titanium dioxide.

The total coating density, i.e., the combined density of both the inner and outer coatings, is from about 2 to about 15 grams per square meter, and preferably from about 4 to about 12 grams per square meter. These values for coating density are also applicable to coatings prepared with other metal oxides, as earlier described.

The cathode herein contemplated may be in the form of a bipolar electrode having a titanium substrate with the ruthenium-tin and ruthenium-palladium-tin containing coatings thereon, the titanium substrate optionally containing a hydride formation inhibiting amount of yttrium, as described herein above, and both layers of the coating being substantially free of deposited titanium, i.e., titanium dioxide.

The electrodes herein contemplated, especially those having the multi-layer, hydrogen barrier coating, may be utilized in the electrolysis of alkali metal chloride brines, i.e., sodium chloride brine containing from about 15 to about 26 weight percent sodium chloride, or potassium chloride brine containing from about 16 to about 24 weight percent potassium chloride, by passing electrical current from an anode to a cathode in a common electrolyte evolving anodic products, e.g., chlorine, and cathodic products, e.g., hydroxyl ion and hydrogen, and forming chlorate ion, either electrolytically or chemically. Chlorate may be formed either within the electrolytic cell or in a separate holding tank.

The electrodes of the preferred exemplification herein contemplated may be prepared in various ways. The two layers are deposited sequentially, atop the conductive substrate. According to one exemplification, a liquid composition of solvent, a thermally decomposable compound of ruthenium and a thermally decomposable compound of tin is deposited on the substrate, i.e., by immersion, brushing, spraying or the like. Thereafter the coated substrate is heated in air or other oxidizing atmosphere whereby to form an oxide or oxides of the ruthenium and tin. This is carried out sequentially until a coating thickness of about 1 gram per square meter to about 10 grams per square meter is prepared. Thereafter, a coating composition containing a suitable solvent, a thermally decomposable ruthenium compound, a thermally decomposable palladium compound, and a thermally decomposable tin compound is prepared, and applied atop the first oxide coating. The application may be carried out as described above, by brushing, spraying, or immersion with heating under oxidizing conditions whereby to form an oxide film of about 1 to 10 grams per square meter.

Suitable solvents include aliphatic alcohols, such as methanol, ethanol, propanol, including isopropanol, and butanols. Alternatively, low molecular weight aliphatic ketones and aldehydes may be used. Suitable thermally decomposable compounds of the metals include simple salts thereof, such as chlorides, carbonates, sulphates, nitrates, and the like as well as organometallic salts thereof such as oxalates, acetates, and the like and fatty acid salts, sold under the designation of resinates.

Alternatively, the coatings may be deposited by electrodeposition, for example, by depositing halide salts, sulfate salts, nitrate salts, or the like and thermally oxidizing the deposit whereby to form the oxide.

The following examples are illustrative of the method of this invention.

EXAMPLE I

A titanium coupon was coated with a ruthenium-palladium-tin composition and tested as a cathode in a beaker chlorate cell.

A 1 inch by 3 inch by $\frac{1}{4}$ inch thick titanium coupon containing 0.023 percent yttrium was degreased with methylene chloride, heated to 52 degrees centigrade in 37 weight percent hydrochloric acid for 45 minutes, and rinsed with deionized water.

A solution was prepared containing:

| | |
|---|---|
| $SnCl_2 \times 2H_2O$ | 0.3 gram |
| $RuCl_3 \times H_2O$ | 1.0 gm |
| HCl (37% aq.) | 20 ml |
| Ethanol (absolute) | 120 ml |
| Water (deionized) | 110 ml |

The coupon was immersed in the solution for one minute, permitted to dry at 27° C. for 5 minutes, and then heated in air at 350° C. for 8 minutes. This was done five times.

Thereafter a solution was prepared containing:

| | |
|---|---|
| Pd (black) | 0.2 gm (dissolved in 3 ml HCl) |
| $SnCl_2 \times 2H_2O$ | 0.3 gm |
| $RuCl_3 \times H_2O$ | 1.0 gm |
| HCl (37% aq.) | 20 ml |
| Ethanol (absolute) | 120 ml |
| Water (deionized) | 110 ml |

The second solution was brushed onto the coupon atop the deposit of the first solution, allowed to dry at 27° C., and then heated at 350° C. in air for 8 minutes. Five coats were applied in this way. After application of the fifth coat the coupon was heated in air at 350° C. for 8 minutes, with the heating continued thereafter at 485° C. in air for 15 minutes. The resulting electrode had a blue-black surface.

The electrode was tested as a cathode in a glass beaker chlorate cell with an electrolyte 270 grams per liter of NaCl, 20 grams per liter of $Na_2SO_4$, and 1.8 grams per liter of $Na_2Cr_2O_7$. The cathode had a cathode potential, versus silver-silver chloride, of 1.14 to 1.20 volts at 230 amperes per square foot.

EXAMPLE II

A laboratory bipolar electrolytic cell was prepared containing ruthenium-tin-palladium coated titanium-yttrium anodes and cathodes.

The laboratory bipolar electrolytic cell had an anodic end plate with anode blades extending therefrom, a cathodic end plate with cathode blades extending therefrom, and a bipolar element with anode blades extending from one side thereof and cathode blades extending from the opposite side thereof. The anodic end unit was a $5\frac{1}{2}$ inch by $5\frac{1}{2}$ inch by $\frac{1}{4}$ inch titanium-yttrium alloy plate with three titanium-yttrium alloy anodes, 3 inch by 3 inch, extending therefrom on a $\frac{1}{4}$ inch pitch. The cathodic end unit was also a $5\frac{1}{2}$ inch by $\frac{1}{4}$ inch titanium-yttrium backplate with three 3 inch by 3 inch titanium-yttrium alloy cathode blades extending therefrom on a $\frac{1}{4}$ inch pitch.

The bipolar element consisted of two titanium-yttrium alloy plates measuring $2\frac{5}{8}$ inches by $5\frac{1}{2}$ inches by $\frac{3}{4}$ inch, a $\frac{1}{4}$ inch by $\frac{3}{4}$ inch by $5\frac{1}{2}$ inch titanium bar, and two $7\frac{1}{4}$ inch by 3 inch titanium bipolar electrode blades.

The bipolar element was constructed with the two electrode blades spaced $\frac{1}{4}$ inch apart by the $\frac{1}{4}$ inch by $\frac{3}{4}$ inch by $5\frac{1}{2}$ inch bar. The $2\frac{5}{8}$ inch by $5\frac{1}{2}$ inch by $\frac{3}{4}$ inch plates were held in compression by the two 9/32 inch steel bolts, each passing through one $2\frac{5}{8}$ inch titanium plate, a bipolar electrode, the $\frac{1}{4}$ inch titanium bar, the second bipolar electrode, and the second $2\frac{5}{8}$ inch titanium plate.

The bipolar element was spaced from each of the end electrode plates by a 96 millimeter inside diameter by $3\frac{1}{2}$ inch long styrene-butadiene copolymer pipe. The bipolar electrolyzer was assembled and held in compression by the rods extending from one end electrode plate through the bipolar element to the opposite end electrode plates.

Two solutions were prepared for coating the titanium-yttrium alloy blades. The first solution contained:

| | |
|---|---|
| $RuCl_3 \times H_2O$ | 2.0 grams |
| $SnCl_2 \times 2H_2O$ | 0.4 gram |
| HCl (37% aq.) | 2.5 ml |
| $H_2O$ (distilled) | 25.0 ml |
| Ethanol (absolute) | 120 ml |

The second solution contained:

| | |
|---|---|
| $RuCl_3 \times H_2O$ | 2.0 grams |
| $SnCl_2 \times 2H_2O$ | 0.4 grams |
| $PdCl_3$ | 0.333 grams |
| HCl (37% aq.) | 3.0 ml |
| $H_2O$ (distilled) | 25.0 ml |
| Ethanol (absolute) | 120 ml |

The titanium blades were an alloy of titanium and 0.0026 weight percent yttrium. The titanium blades were blasted with medium grit glass beads, degreased in methylene chloride for 30 minutes, etched in 20 weight percent HCl at 50° C. for 30 minutes and rinsed in distilled water. The blades were then brushed on both surfaces with the first coating solution, heated in air at 350° C. for 5 minutes and allowed to cool. Four coats of the first solution were applied in this way. Thereafter the blades were brushed on both surfaces with the second coating solution heated in air at 350° C. for five minutes, and allowed to cool. Three coats were applied in this way.

The bipolar electrolyzer having two electrolytic cells was assembled as described above and operated. The following results were obtained:

| | | | |
|---|---|---|---|
| Days On Line (Cumulative) | 3 | 8 | 10 |
| Cell Volts (Cell I) | 2.93 | 2.92 | 2.94 |
| Cell Temp. (Cell I) (°C.) | 48 | 48 | 48 |
| Cell Volts (Cell II) | 2.80 | 2.84 | 2.85 |
| Cell Temp. (Cell II) (°C.) | 58 | 58 | 57 |
| pH | 6.75 | 6.72 | 6.82 |
| $NaClO_3$ (grams/liter) | 578 | 557 | 559 |
| NaCl (grams/liter) | 105 | 118 | 113 |
| $NaClO_3$ efficiency (%) | 79% | 80% | 81% |
| Current Density (Amperes/$Ft^2$) | 240 | 240 | 240 |

EXAMPLE III

A nickel coupon was coated with a ruthenium-palladium-tin composition and tested as a cathode in an electrolytic cell.

Nickel coupons (2 inch by $\frac{3}{4}$ inch by 1/16 inch thick) were buffed with a wire wheel to remove gross surface oxidation and then degreased with methylene chloride at ambient temperature (24° C.±2° C.) and blown dry with nitrogen. The degreased coupons were immersed in concentrated (12N) hydrochloric acid at ambient temperature until a uniform evolution of gas bubbles were observed from the coupons. The coupons were rinsed well with distilled water and then given the ruthenium-tin/ruthenium-palladium-tin composition coating.

A first solution was prepared containing:

| | |
|---|---|
| $RuCl_3 \times H_2O$ | 2.0 grams |
| $SnCl_2 \times 2H_2O$ | 0.4 gram |
| HCl (12N-Concentrated) | 2.5 ml |
| Water (Distilled) | 25 ml |
| Ethanol (Absolute) | 120 ml |

One face of a coupon (A) was painted with the above first solution and the coating permitted to air dry slightly and then placed in a 350° C. oven for five minutes. The coupon was removed from the oven and permitted to cool. This procedure was repeated two more times until three coatings were applied to the coupon. Thereafter, the coated face of the coupon was treated with the following described second solution:

| | |
|---|---|
| Pd (Black) | 0.2 gram* |
| $RuCl_3 \times H_2O$ | 2.0 gram |
| $SnCl_2 \times 2H_2O$ | 0.4 gram |
| HCl (Concentrated) | 3.0 ml |
| Water (Distilled) | 25 ml |
| Ethanol (Absolute) | 120 ml |

*Dissolved in HCl—$HNO_3$ and taken to near dryness.

The treated face of the coupon was treated with the second solution in the same manner as the first solution except that the heat treatment following application of the third application of the second solution was for ten minutes.

A second nickel coupon (B) was treated in the same manner as nickel coupon (A) except that 2.5 ml and 2.0 ml of concentrated HCl were added respectively to the first and second coating solutions.

Two coated nickel coupons were tested as cathodes in a beaker cell containing 25 weight percent sodium hydroxide at 70° C.±1° C. A nickel electrode was used for the anode in the beaker cell. Each of the coated nickel electrodes were tested over a range of current densities from 100–800 amps/$ft^2$ and the cathode potential measured under conditions of electrolysis with respect to a Ag/AgCl reference electrode. Results obtained are tabulated in the following Table.

| Current Density (Amps/$ft^2$) | Cathode Potential (Volts) vs Ag/AgCl | |
|---|---|---|
| | Coupon A | Coupon B |
| 100 | 1.12 | 1.12 |
| 200 | 1.13 | 1.16 |
| 400 | 1.16 | 1.16 |
| 800 | 1.15 | 1.13 |
| 800 | 1.16 | 1.15 |

EXAMPLE IV

Mild steel coupons (4 inches by 1 inch by 1/32 inch thick) were sandblasted and degreased with methylene chloride. The degreased coupons immersed in 8N hydrochloric acid for ten minutes. The plating solution was prepared from the following ingredients:

| | |
|---|---|
| Succinic Acid | 23.32 grams |
| Sodium Hydroxide | 15.80 grams |
| Malic Acid | 36.0 grams |
| Lead Chloride ($PbCl_2$) | 0.0037 gram |
| Nickel Sulfate ($NiSO_4$—$6H_2O$) | 38.9 grams |
| Sodium Hypophosphite | 44.7 grams |

The pH of the plating solution was adjusted to about 6 with solid sodium hydroxide.

The HCl treated coupons were immersed in the plating solution for two hours at 85° C. On removal, the coupons were rinsed with distilled water, dried with acetone and placed in a 400° C. furnace for one hour. The nickel-phosphorous coated coupons were removed from the furnace and air cooled.

One of the coupons was made cathodic in a chlorate cell liquor for 10 minutes at 50 amps/ft$^2$, washed with distilled water and given an intermediate coating of ruthenium-tin and a final top coating of ruthenium-tin-palladium using coating solutions as describe in Example III. The intermediate and top coatings were applied by painting the surface eight times with each of the respective coating solutions and heat treating the coupon in a 400° C. furnace for 15 minutes after each application of the coating solution. After the final application of the top coating solution, the coupon was heat treated for one hour at 400° C. as a final annealing step.

The nickel-phosphorous coated steel coupon was tested as a cathode in a laboratory glass beaker chlorate cell at 223 amps/ft$^2$ at 50° C. The active area of the coupon was 1 inch by 1 inch. The electrolyte of the cell contained 606 grams/liter(gpl) of sodium chlorate, 128 gpl of sodium chloride and 2.6 gpl of sodium dichromate ($Na_2Cr_2O_7$). The nickel-phosphorous coated coupon gave a cathode potential of 1.48–1.50 volts versus a silver-silver chloride reference electrode.

The nickel-phosphorous coated steel coupon with the ruthenium-tin/ruthenium-tin-palladium superposed coatings was tested as a cathode (active area 1 square inch) in the aforesaid glass beaker chlorate cell at the same current density and temperature. The cathode potential was determined to be 1.16–1.17 volts versus the silver/silver chloride reference electrode. This demonstrates the utility of mild steel coated with a nickel-phosphorous alloy as a substrate for the Group VIII metal oxide coatings of the present invention.

While the invention has been described with respect to certain preferred exemplifications and embodiments, it is not intended that the scope of protection be limited thereby, but only by the claims appended hereto.

We claim:

1. In an electrode having a titanium substrate with a ruthenium containing coating thereon, the improvement wherein said coating is substantially free of deposited titanium and comprises:

(1) a first oxide layer, deposited on said substrate and comprising a major portion of ruthenium and a minor portion of tin; and (2) a second oxide layer, atop said first layer, comprising a major portion of ruthenium and minor portions of tin and palladium.

2. The electrode of claim 1 wherein the substrate contains from about 0.0002 to about 0.01 weight percent yttrium.

3. The electrode of claim 1 wherein the first oxide layer contains from about 75 to about 90 weight percent ruthenium, basis elemental metal.

4. The electrode of claim 1 wherein the first oxide layer has a coating density of from about 1 to about 10 grams per square meter.

5. The electrode of claim 1 wherein the second oxide layer contains from about 80 to about 85 weight percent ruthenium, from about 7 to about 10 weight percent palladium, and from about 6 to about 10 weight percent tin, basis elemental metal.

6. The electrode of claim 1 wherein the second oxide layer has a coating density of from about 1 to about 10 grams per square meter.

7. In a bipolar electrolyzer having a plurality of bipolar electrodes, parallel to and spaced from each other, each of said bipolar electrodes comprising a titanium plate having an anodic portion and a coated cathodic portion whereby the cathodic portion of one bipolar electrode faces the anodic portion of a prior bipolar electrode and the anodic portion of the bipolar electrode faces the cathodic portion of a subsequent bipolar electrode, the improvement wherein said cathodic coating is substantially free of deposited titanium and comprises:

(1) a first oxide layer, deposited on said plate and comprising a major portion of ruthenium and a minor portion of tin; and (2) a second oxide layer, atop said first layer, comprising a major portion of ruthenium and minor portions of tin and palladium.

8. The bipolar electrolyzer of claim 7 wherein the substrate is a titanium-yttrium alloy containing from about 0.0002 to about 0.01 weight percent yttrium.

9. The bipolar electrolyzer of claim 7 wherein the first oxide layer contains from about 75 to about 90 weight percent ruthenium basis elemental metal.

10. The bipolar electrolyzer of claim 7 wherein the first oxide layer has a coating density of from about 1 to about 10 grams per square meter.

11. The bipolar electrolyzer of claim 7 wherein the second oxide layer contains from about 80 to about 85 weight percent ruthenium, from about 7 to about 10 weight percent palladium, and from about 6 to about 10 weight percent tin, basis elemental metal.

12. The bipolar electrolyzer of claim 7 wherein the second oxide layer has a coating density of from about 1 to about 10 grams per square meter.

13. In a bipolar electrolyzer having a plurality of anodes extending into the electrolyzer from one end thereof, a plurality of cathodes extending into the electrolyzer from an opposite end thereof, and a plurality of bipolar electrode blades, each of said bipolar electrode blades having a cathodic portion, and an anodic portion, said anodes, cathodes and bipolar electrode blades being mutually parallel, the first group of bipolar electrode blades being arrayed between and parallel to the anodes and having the cathodic portions thereof opposed to the anodes and the anodic portions thereof remote from the anodes, the last group of bipolar electrode blades being arrayed between and parallel to the cathodes and having the anodic portions thereof opposed to the cathodes and the cathodic portions thereof remote from the cathodes, the improvement wherein said bipolar electrode blades comprise:

(a) a titanium substrate, and (b) a coating thereon substantially free of deposited titanium and comprising:

(1) a first oxide layer, deposited on said substrate and comprising a major portion of ruthenium and a minor portion of tin; and (2) a second oxide layer, atop said first oxide layer, comprising a major portion of ruthenium and minor portions of tin and palladium.

14. The bipolar electrolyzer of claim 13 wherein the substrate contains from about 0.0002 to about 0.01 weight percent yttrium.

15. The bipolar electrolyzer of claim 13 wherein the first layer contains from about 75 to about 90 weight percent ruthenium basis elemental metal.

16. The bipolar electrolyzer of claim 13 wherein the first oxide layer has a coating density of from about 1 to about 10 grams per square meter.

17. The bipolar electrolyzer of claim 13 wherein the second oxide layer contains from about 80 to about 85 weight percent ruthenium, from about 7 to about 10 weight percent palladium, and from about 6 to about 10 weight percent tin, basis elemental metal.

18. The bipolar electrolyzer of claim 13 wherein the second oxide layer has a coating density of from about 1 to 10 grams per square meter.

19. In a method of electrolyzing alkali metal chloride brine comprising passing electrical current from an anode to a cathode in a common electrolyte, evolving anodic and cathodic products and forming chlorate ion, the improvement wherein said cathode comprises:

(a) a titanium substrate; and (b) a coating thereon, substantially free of deposited titanium, comprising:

(1) a first oxide layer, deposited on said substrate and comprising a major portion of ruthenium and a minor portion of tin; and (2) a second oxide layer, atop said first oxide layer, comprising a major portion of ruthenium and minor portions of tin and palladium.

20. The method of claim 19 wherein the substrate contains from about 0.0002 to about 0.01 weight percent yttrium.

21. The method of claim 19 wherein the first oxide layer contains from about 75 to about 90 weight percent ruthenium, basis elemental metal.

22. The method of claim 19 wherein the first oxide layer has a coating density of from about 1 to about 10 grams per square meter.

23. The method of claim 19 wherein the second oxide layer contains from about 80 to about 85 weight percent ruthenium, from about 7 to about 10 weight percent palladium, and from about 6 to about 10 weight percent tin, basis elemental metal.

24. The method of claim 19 wherein the second oxide layer has a coating density of from about 1 to 10 grams per square meter.

25. A method of preparing an electrode on a titanium substrate comprising:

(a) depositing a first composition consisting essentially of a solvent, a thermally decomposable ruthenium compound and a thermally decomposable tin compound onto the titanium substrate, and decomposing the ruthenium compound and tin compound in an oxidizing atmosphere, to form a first oxide layer comprising a major portion of ruthenium and a minor portion of tin; and (b) thereafter depositing a second composition consisting essentially of a solvent, a thermally decomposable ruthenium compound, a thermally decomposable tin compound, and a thermally decomposable palladium compound atop the first oxide layer, and decomposing the ruthenium compound, tin compound, and palladium compound in an oxidizing atmosphere to form a second oxide layer comprising a major portion of ruthenium and minor portions of tin and palladium.

26. The method of claim 25 wherein the titanium substrate comprises a hydride formation inhibiting amount of yttrium.

27. The method of claim 26 wherein the titanium substrate contains from about 0.0002 to about 0.01 weight percent yttrium.

28. The method of claim 25 wherein the first oxide layer contains from about 75 to about 90 weight percent ruthenium, basis elemental metal.

29. The method of claim 25 wherein the first oxide layer has a coating density of from about 1 to about 10 grams per square meter.

30. The method of claim 25 wherein the second oxide layer contains from about 80 to about 85 weight percent ruthenium, from about 7 to about 10 weight percent palladium, and from about 6 to about 10 weight percent tin, basis elemental metal basis.

31. The method of claim 25 wherein the second oxide layer has a coating density of from about 1 to about 10 grams per square meter.

32. An electrode for an electrolytic cell comprising:

(a) a substrate selected from the group consisting of titanium, copper, and silver, and (b) a coating substantially free of deposited titanium and comprised of a first oxide layer on said substrate of a major amount of ruthenium and a minor amount of tin, and a second oxide layer atop said first layer of a major amount of ruthenium and minor amounts of tin and palladium.

33. The electrode of claim 32 wherein the substrate is titanium or titanium alloy containing minor amounts of at least one metal from Group III or Group VIII.

34. The electrode of claim 33 wherein the substrate is a titanium-yttrium alloy.

* * * * *